US005265573A

United States Patent [19]

Imoli

[11] Patent Number: 5,265,573

[45] Date of Patent: Nov. 30, 1993

[54] INDUCTIVE DISCHARGE IGNITION SYSTEM FOR INTERNAL COMBUSTION ENGINES

[75] Inventor: Dante Imoli, Biadene, Italy

[73] Assignee: I D M S.R.L., Biadene, Italy

[21] Appl. No.: 807,872

[22] PCT Filed: Jul. 12, 1990

[86] PCT No.: PCT/EP90/01136

§ 371 Date: Jan. 21, 1992

§ 102(e) Date: Jan. 21, 1992

[87] PCT Pub. No.: WO91/01446

PCT Pub. Date: Feb. 7, 1991

[30] Foreign Application Priority Data

Jul. 25, 1989 [IT] Italy ..... 84144 A/89

[51] Int. Cl.[5] ..... F02P 1/08

[52] U.S. Cl. ..... 123/418; 123/424; 123/149 C

[58] Field of Search ..... 123/149 C, 424, 418, 123/149 D

[56] References Cited

U.S. PATENT DOCUMENTS

| | | | |
|---|---|---|---|
| 3,667,441 | 6/1972 | Cavil | 123/149 D |
| 3,722,488 | 3/1973 | Swift et al. | 123/149 D |
| 3,809,040 | 5/1974 | Burson et al. | 123/149 D |
| 4,188,930 | 2/1980 | Santi | 123/149 C |
| 4,270,509 | 6/1981 | Tharman | 123/149 C |
| 4,282,839 | 8/1981 | Newberry et al. | 123/418 |
| 4,606,323 | 8/1986 | Nash | 123/602 |

FOREIGN PATENT DOCUMENTS

| | | |
|---|---|---|
| 0131905 | 1/1985 | European Pat. Off. . |
| 2638616 | 3/1978 | Fed. Rep. of Germany . |

*Primary Examiner*—Andrew M. Dolinar

*Attorney, Agent, or Firm*—Hoffman, Wasson & Gitler

[57] ABSTRACT

An inductive discharge ingnition system for internal combustion engines, comprising a permanent magnet rotating syncronously with the engine and passing in front of an ignition coil and a control coil during its movement. The control coil controls a controlled discharge electronic circuit connected in series with the primary winding of the ignition coil, the secondary winding of which is connected to the electrodes of a spark plug. The assembly formed from the ignition coil and the control coil is configured in such a manner as to trigger the spark with an advance compatible with that required by the engine on starting.

2 Claims, 3 Drawing Sheets

INDUCTIVE DISCHARGE IGNITION SYSTEM FOR INTERNAL COMBUSTION ENGINES

This invention relates to an inductive discharge ignition system for internal combustion engines.

Inductive discharge systems for internal combustion engines are known. Essentially, they use a permanent magnet connected to the crankshaft so that it rotates synchronously with it. The rotating magnet is faced by an ignition coil wound on a magnetic core and comprising a primary winding and a secondary winding. The secondary winding is connected to the electrodes of a spark plug, and the primary winding is connected to an electronic circuit which interrupts it. This interruption is controlled by a small control coil generally located in proximity to the ignition coil. In practice the engine rotation, and thus the relative movement between the permanent magnet and the ignition coil, induces an electromotive force in the primary winding of this latter, to cause circulation of a current which is suddenly interrupted by the electronic circuit when the permanent magnet passes in front of the control coil. The sudden and considerable flux variation which occurs on interruption of the primary current in the ignition coil induces a high secondary voltage which triggers the spark between the spark plug electrodes.

The shape of the various parts and their locations are determined such that the primary current interruption takes place when this current is at its maximum value, and in synchronism with the operating cycle of the internal combustion engine.

However, in practice the petrol-air mixture requires a certain time to ignite, and it is therefore necessary for the ignition command, i.e. the interruption in the primary circuit of the ignition coil, to take place with a certain advance relative to the predetermined moment of explosion. This is generally obtained by positioning the control coil in angular advance of that position of the permanent magnet shaft which corresponds to the top dead center of the relative cylinder.

Again, as the time required for the petrol-air mixture to burn completely is substantially constant whereas the advance time, i.e. the time interval between the moment in which the permanent magnet passes in front of the control coil and the moment corresponding to said top dead center, is related to the engine rotational speed, this adjustment system cannot be effective both at high and low engine speed.

Two methods are currently used to obviate this drawback. One of this consists of inducing the interruption in the primary current by means of a microprocessor or in any event by a sophisticated electronic circuit which takes account of the engine rotational speed and adjusts the ignition advance on this basis. This methods is without doubt valid, but involves a high constructional cost and the need for a central electronic control unit, and for these reasons cannot be advantageously used in small internal combustion enginees, in which its cost and overall size impose very restrictive limits.

Another known methods currently used for small internal combustion engines is to set the ignition advance to correspond to maximum rotational speed, i.e. to normal operating conditions, and to use a controlled discharge transistor in the electronic primary current interruption circuit to ensure operation in proper time.

The main drawback of this method is that at speeds other than the maximum speed, and in particular on starting, ignition takes place too soon before the piston has reached its top dead center, resulting in kick-back which is highly undesirable not only because of the stress to which the engine is subjected but also of its effect on the operator, who generally starts the engine manually.

DE-A-2 638 616 discloses an inductive discharge ignition system for internal combustion engines comprising a permanent magnet, an ignition coil, a control coil and a controlled discharge electronic circuit connected in series with the primary winding of the ignition coil. The core of the control coil consist of a portion of the core of the ignition coil extending tangentially to the movement of the permanent magnet. The assembly formed by the ignition coil and the control coil is configured that at increasing the engine speed from starting to the maximum the advance of the spark increases so as to be correct substantially for each speed.

However this ignition system requires a particular configuration of the core, which is expensive, is different for different engines, is not obtainable from the component already existing and does not allow any displacement of the control coil with respect to the ignition coil for set up and adjustment purpose.

An object of the invention is to solve this problem by providing automatic advance adjustment in small internal combustion engines, both on starting and at maximum engine speeds.

A further object of the invention is to solve this problem in an extremely reliable, simple and economical form and requiring little space.

These and further objects which will be more apparent from the description given hereinafter are attained according to the invention by an inductive discharge ignition system for internal combustion engines, comprising a permanent magnet rotating syncronously with the engine and passing in front of an ignition coil and a control coil during its movement, said control coil controlling a controlled discharge electronic circuit connected in series with the primary winding of the ignition coil, the secondary winding of which is connected to the electrodes of a spark plug, wherein the assembly formed from the ignition coil and the control coil is configured in such a manner as to trigger the spark with an advance compatible with that required by the engine on starting, characterized in that the core of the control coil comprises a first portion extending perpendicularly to the movement of the permanent magnet and two second portions extending perpendicularly from both ends of said first portion, the dimension of said first and second portions of said core being such that two voltage peaks are generated in the control coil and that, at low speed, the angularly first one of them is smaller than the threshold of the electronic circuit, the circuit being triggered by the angularly second peak, whereas at high speed said angularly first peak is higher than the threshold of said circuit such that said circuit is triggered by said angularly first peak.

The invention, deriving from a series of experimental tests conducted in order to observe the behaviour of the control coil output voltage as the shape of the core varies, is based on the surprising observation that if the shape of the core, instead of being rectilinear in a direction radial to the rotational motion of the permanent magnet, also comprises a tangential component, the normally existing voltage peak is displaced in the delay direction, and in its place there forms another voltage peak having an amplitude related to the rotational speed of the engine and in particular increasing with it.

Some preferred embodiments of the present invention are described hereinafter with reference to the accompanying drawings, in which.

Figure 1:
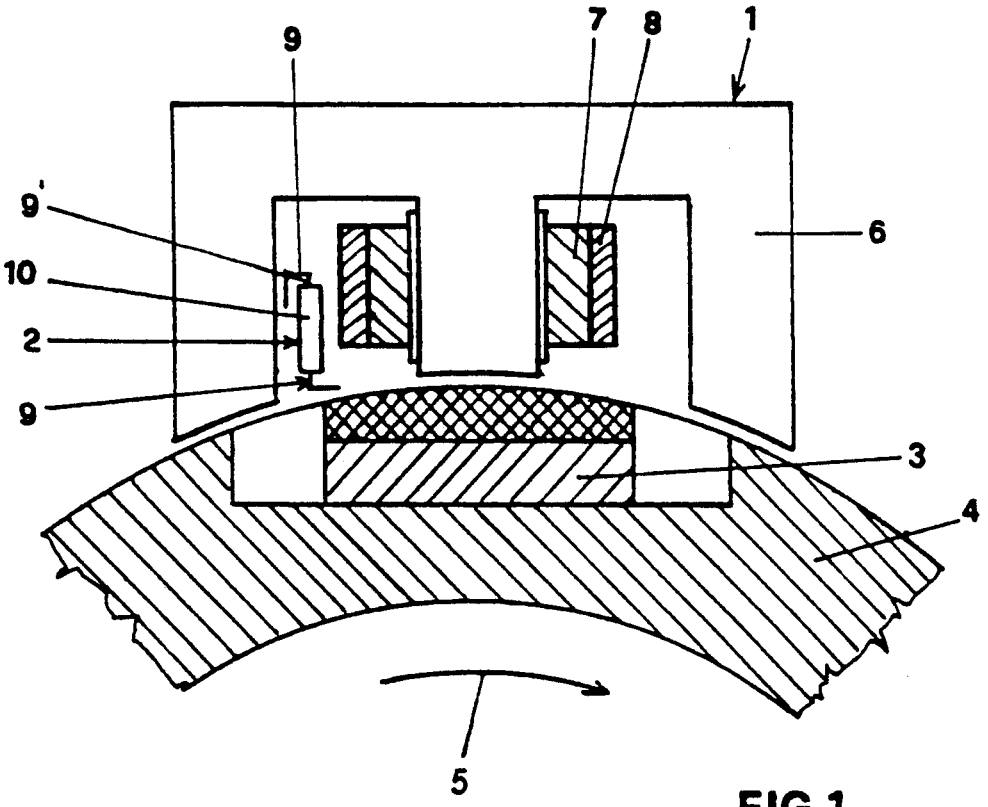
FIG. 1 is a schematic cross-section through an ignition system according to the invention.
Figure 2:
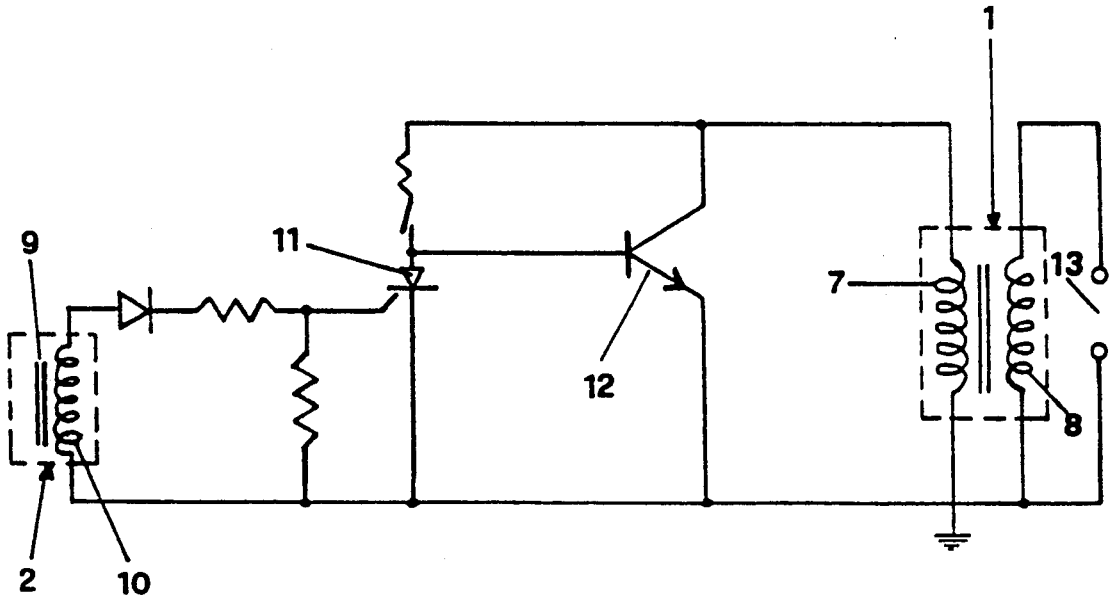
FIG. 2 shows a simplified electrical schematic of the invention.

As can be seen from the figures the inductive discharge ignition system of the invention comprises a fixed ignition coil indicated overall by 1, a fixed control coil indicated overall by 2, and a permanent magnet 3 mounted on the engine flywheel 4 in position such that when the magnet rotates in the direction of the arrow 5 of FIG. 1 it passes firstly in front of a pole piece of the ignition coil 1 and then in front of the control coil 2. The configuration of the ignition coil and control coil and their position relative to the flywheel are determined such that the ignition advance substantially corresponds to that required at minimum engine rotational speed, i.e. on starting.

The ignition coil 1 comprises an E-shaped core 6 with three pole pieces facing the flywheel 4, and a primary winding 7 and secondary winding 8 arranged concentrically to each other about its central portion.

The control coil 2 comprises a core 9 and a winding 10 arranged about it. The core 9 comprises a part 9' positioned slightly offset from perpendicular to the circumferential surface of the flywheel 4, i.e. radial to its axis of rotation, and two parts 9" perpendicular to the preceding. From the circuit aspect, the winding 10 is connected to the input of an SCR transistor 11 having a threshold value less than the amplitude of the voltage peak which is generated, as will be apparent hereinafter, by the flux variation through the core on passage of the magnet 3.

The output of the SCR transistor 11 is connected to a Darlington circuit, indicated schematically as a transistor 12, which is connected to the primary winding 7 of the ignition coil 1.

The secondary winding 8 of the coil 1 is connected to the electrodes of a spark plug 13.

Figure 3:
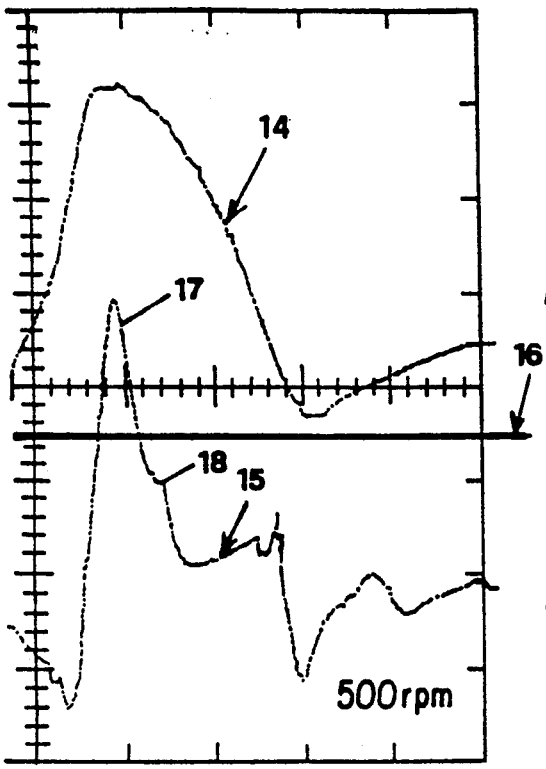
FIG. 3 shows the pattern of the control coil output voltage in relation to the threshold value of the controlled discharge transistor and to the pattern of the ignition coil primary current ia traditional ignition system, under minimum engine speed (starting) conditions.

To better understand the operation of the ignition system according to the invention and the considerable differences compared with a traditional system, it will be advantageous firstly to examine the operation of the traditional case with reference of FIG. 3, specifically for a rotational speed of 500 r.p.m., corresponding substantially to starting conditions.

When the engine is still at rest the SCR and transistor 12 do not conduct and no current passes through the primary winding 7.

On starting, the passage of the permanent magnet 3 in front of the ignition coil results in a flux variation which induces a current in its primary winding 7. The pattern of this current is represented by the curve 14 in FIG. 3, in which the horizontal axes represent the angular position of the permanent magnet 3 relative to a predetermined reference position, and the vertical axes indicate the primary current intensity. It can be clearly seen from these graphs that when the magnet 3 passes in front of the pole pieces of the core 6 of the coil 1, the primary current assumes a "bell-shaped" pattern.

When the magnet 3 passes in front of the control coil 2, it induces in its winding 10 a voltage the pattern of which is represented by the curve 15 of FIG. 3. In this graph the horizontal axes again represent the angular position of the permanent magnet 3, whereas the vertical axes represent the control voltage.

FIG. 3 also shows at 16 the pattern (constant) of the threshold voltage of the SCR 11.

Essentially, the voltage induced in the primary winding 7 on passage of the permanent magnet 3 is sufficient to polarize the transistor 12 which thus shorts the primary circuit so that a high current passes through it. When this current reaches a sufficiently high value, the voltage peak 17 induced in the winding 10 of the control coil 2 at minimum speed, and in particular on starting, trips the SCR 11, which inhibits the transistor 12 and suddenly interrupts current passage through the primary winding 7. This sudden interruption produces a sudden intense flux variation in the core 6, and thus a high secondary voltage, which powers the spark plug 13.

In traditional system the position of the assembly comprising the ignition coil 1 and the control coil 2 is determined such that the voltage peak 17 which trips the SCR 11 occurs at a moment such as to trigger the spark in the spark plug 13 with an advance corresponding to maximum speed operation. This peak is followed by a second peak 18 which can just be seen in FIG. 3, but does not influence the operation of the assembly.

In contrast, according to the invention the particular shape of the core 9 of the control coil 2, and in particular the presence of the two tangential parts 9", substantially reduces the amplitude of the first peak 17, making it practically without influence at low speeds, whereas it enhances the amplitude of the second peak 18 to make it able to trip the SCR 11 and trigger the park in the spark plug 13. This takes place with an ignition advance which makes the operation of the ignition system satisfy the conditions required for starting. In addition, as the rotational speed of the engine increases the curve 15 showing the voltage induced in the winding 10 of the control coil 2 changes in the sense that the peak 17 increases progressively in amplitude.

When this amplitude reaches the threshold value of the SCR 11, which occours at full speed operation, the SCR 11 trips in advance of the position in which it was controlled by the peak 18, with the double effect of advancing the spark formation in the spark plug 13, and of nullifying the effect of said peak 18.

Figure 4:
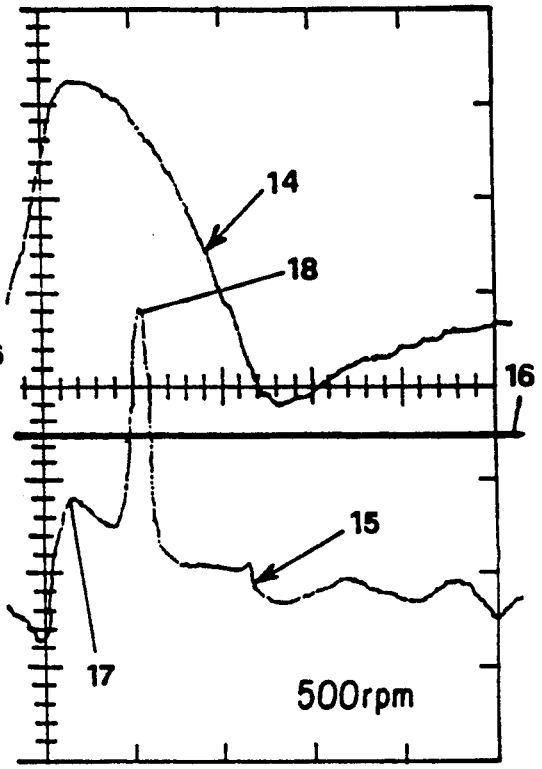
FIGS. 4 to 6 show the pattern of the same quantities in an ignition system according to the invention, under three different operating conditions.

More particularly FIG. 4, which corresponds to the same operating conditions as FIG. 3, shows the curve 15 of the voltage induced in the coil 1, which at a certain moment exceeds the threshold voltage of the SCR 11 to cause interruption of the primary current in the coil 1, when this current has the value indicated by the curve 14 at the same abscissa value.

The rotational speed of the engine in the experimental situation of FIG. 4 corresponds to 500 r.p.m., with the voltage induced in the coil 2 showing inversion between the two peaks 17 and 18.

Figure 5:
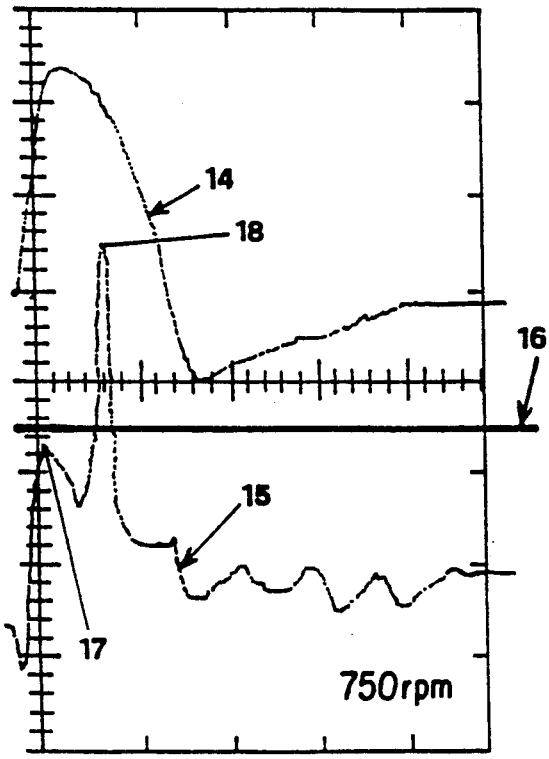

FIG. 5 (750 r.p.m.) shows the increase amplitude of the first peak 17, but still insufficient to reach the threshold level 16 of the SCR 11, and this therefore continues to be tripped by the peak 18.

Figure 6:
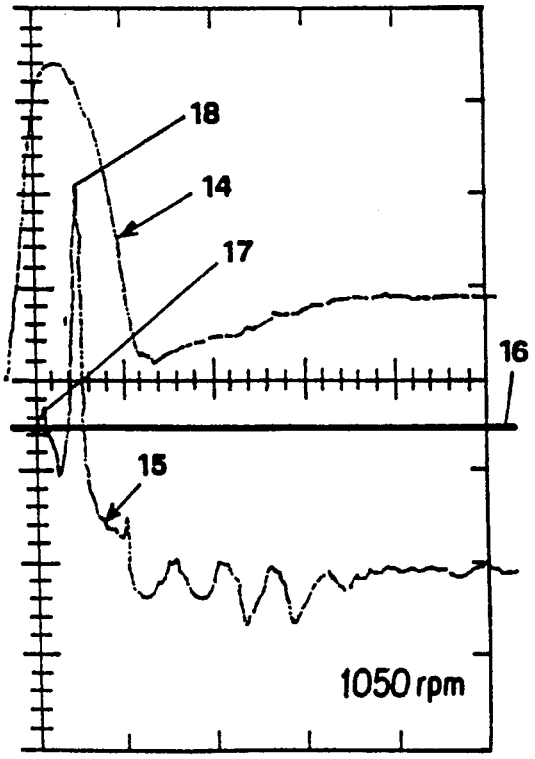

FIG. 6 (1050 r.p.m.) shows that the amplitude of the peak 17 is such as to exceed the threshold level 16 of the SCR 11, so that this is tripped at a primary current level slightly different from the preceding, but still high. The distance expressed in degrees between the two peaks 17 and 18 is about 12° and corresponds approximately to the difference between the advance required for starting and that required for maximum engine speed.

Essentially, by virtue of this very simple expedient of giving the core 9 of the control coil 2 a particular shape, correct advance is automatically obtained both at high engine speed and on starting.

The wave form of the control voltage is related to the characteristics of the core 9 of the control coil 2, and in the illustrated example corresponds to the shape of the core shown in FIG. 1. Varying this shape varies the pattern of the control voltage, thus providing considerable facility for adjusting the engine ignition advance.

Figure 7:
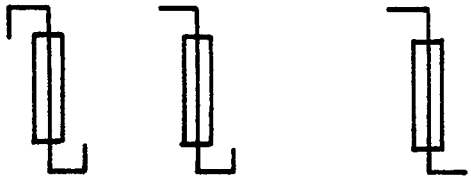
FIG. 7 shows some different core shapes for the control coil.

FIG. 7 shows further shapes of the core 9 of the coil 2, giving different corresponding wave forms of the control voltage 15.

Figure 8:
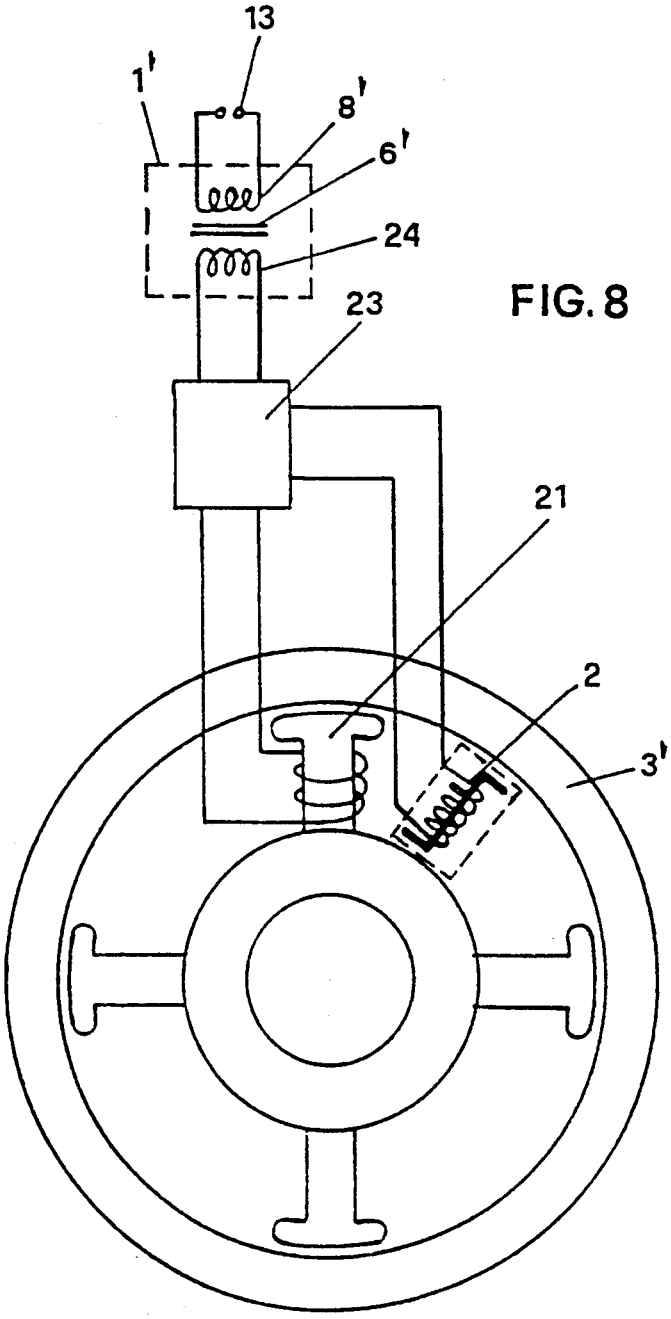
FIG. 8 shows in schematic section the ignition system according to the invention applied to an alternator.

The embodiment shown in FIG. 8 relates to an alternator with a rotating magnet 3' and a salient pole stator. One of these poles 21 is provided with a winding which is connected in series with an electronic circuit 23 for interrupting the primary current and with another primary winding 24 provided on the core 6' of an external ignition coil 1', which also comprises a secondary winding 8' for powering the spark plug 13. The control coil 2 is provided to the side of pole 21.

The operation is substantially the same in this case, in the sense that the various parts are located such that the ignition advance is compatible with that required for starting. The particular shape of the core of the control coil means that its response curve can be modified in the sense of increasing this advance as the engine r.p.m. increases, so that at full speed the correct value for this operating condition is obtained.

I claim:

1. An inductive discharge ingnition system for internal combustion engines, comprising a permanent magnet rotating syncronously with the engine and passing in front of an ignition coil and a control coil during its movement, said control coil controlling a controlled discharge electronic circuit connected in series with the primary winding of the ignition coil, the secondary winding of which is connected to the electrodes of a spark plug, wherein the assembly formed from the ignition coil and the control coil is configured in such a manner as to trigger the spark with an advance compatible with that required by the engine on starting, characterized in that the core of the control coil comprises a first portion extending slightly offset from perpendicular to the movement of the permanent magnet and two second portions extending perpendicularly from both ends of said first portion, the dimension of said first and second portions of said core being such that two voltage peaks are generated in the control coil and that, at low speed, the angularly first one of them is smaller than the threshold of the electronic circuit, the circuit being triggered by the angularly second peak, whereas at high speed said angularly first peak is higher than the threshold of said circuit such that said circuit is triggered by said angularly first peak.

2. An ignition system as claimed in claim 1, characterized in that at least one of said second portions of the core has at its end a short third portion bent parallelly to said first portion and directed towards the other second portion.

* * * * *